United States Patent [19]

Koch, II et al.

[11] 3,999,306

[45] Dec. 28, 1976

[54] ANTI-POLLUTION DRYING OVEN

[75] Inventors: Robert L. Koch, II; William D. Graig, both of Evansville, Ind.

[73] Assignee: George Koch Sons, Inc., Evansville, Ind.

[22] Filed: Mar. 21, 1975

[21] Appl. No.: 560,816

[52] U.S. Cl. ..... 34/225; 34/233; 34/216; 432/144

[51] Int. Cl.[2] ..... F26B 19/00

[58] Field of Search ..... 34/32, 35, 39, 72, 86, 34/209, 210, 215, 216, 217, 224, 225, 232–234; 432/105, 107, 142–146, 72; 126/21 A, 19 R

[56] References Cited

UNITED STATES PATENTS

| | | | |
|---|---|---|---|
| 2,328,078 | 8/1943 | Kugler | 432/72 |
| 2,351,487 | 6/1944 | Cooney | 34/86 |
| 2,558,338 | 6/1951 | Clements | 34/86 |
| 2,703,539 | 3/1955 | Cook | 432/145 |
| 3,214,844 | 11/1965 | Oates et al. | 34/216 |
| 3,473,792 | 10/1969 | Arnold et al. | 432/145 |
| 3,757,427 | 9/1973 | Wilkinson | 34/32 |

*Primary Examiner*—Kenneth W. Sprague
*Assistant Examiner*—James C. Yeung
*Attorney, Agent, or Firm*—Jenkins, Hanley & Coffey

[57] ABSTRACT

An oven for drying an applied coating material having volatile properties characterized by an arrangement of components which minimize the effects of air pollution and, at the same time, satisfies governmental regulations in this regard.

3 Claims, 2 Drawing Figures

ANTI-POLLUTION DRYING OVEN

Figures 1, 2:
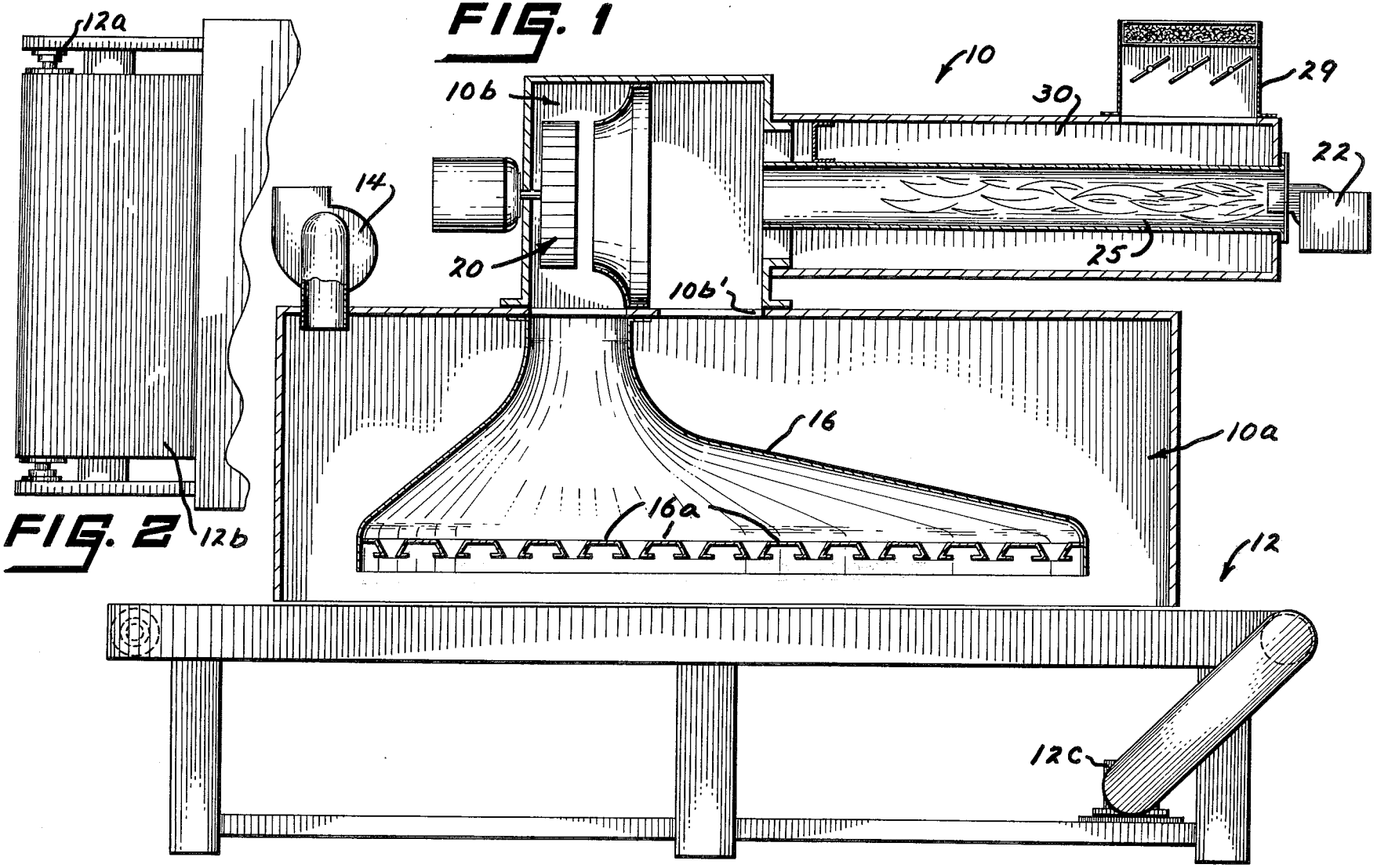

As is known, the use of fast-dry, high-velocity, high-volume, and low-temperature drying ovens is an important commercial factor. A principal objective is the movement of a high volume of warm air at a high velocity onto a surface to afford fast and efficient removal of a wide range of volatiles from liquid coatings. In order to accomplish drying, such coating volatiles must pass from the coating to air adjacent the coating, where the latter is oftentimes heavily saturated with volatiles and additional solvent.

Many of the previously employed drying approaches proved objectionable, considering the desirability of achieving clean or unpolluted air, an ecological factor growing in importance. In order to attain high standards in this latter connection, regulatory governmental bodies have been enacting various restrictions. One requirement, for example, and particularly adaptable to drying ovens, is that organic solvent(s), or any material containing organic solvent(s), does not come in contact with flame, as from the oven burner.

Accordingly, in order to accomplish improved environmental conditions, existing drying oven installations have been reconsidered with the goal of no, or at least minimal, air pollution, particularly relative to the stated requirement of the non-contact of an organic solvent or any material containing an organic solvent with flame.

At the outset, previous arrangements typically included the direct introduction of the flame into the drying oven and, therefore, the contacting thereof with air carrying suspended volatile material. In the alternative, an indirect fired drying oven has been employed, i.e. the heat from the burner was channeled in a tortious path through the drying oven to the outside, heating, by radiation, the space from which air was drawn toward the surface being dried. The latter proved costly in operation in view of the fact that the heat return from the burner became exhausted and/or was ineffective.

In accordance with the invention, a virtually pollution free drying oven is afforded, where the heat from the burner is directly channeled into a chamber containing the blower fan, the flame itself being contained within a channelway, and thereby eliminating any direct contact by the flame with organic solvent or material containing organic solvent.

Restated, and briefly, the invention includes a heating source or burner having a flame directed into a passageway, the latter emptying into a chamber containing a blower fan for passage of heated air onto a surface under drying action. Fresh outside air enters a passageway surrounding the passageway for the burner flame and becomes heated. The arrangement further includes an exhaust fan to the outside and means, such as a belt conveyor, for movement of the coated article(s) for purposes of drying.

A better understanding of the present invention will become more apparent from the following description, taken in conjunction with the accompanying drawing, wherein FIG. 1 is a view in side elevation, partly in vertical section, showing an anti-pollution drying oven in accordance with the teachings of the present invention; and, FIG. 2 is a top plan view, partly broken away, showing certain features of the arrangement of FIG. 1, looking from left to right in such figure.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the drying oven of the invention typically includes an insulated housing 10 defined as an oven enclosure 10*a* and a heater enclosure 10*b* disposed over a conveyor bed 12. The latter supports, as by a sprocket arrangement 12*a*, a conventional belt conveyor 12*b*, for example, on which articles (not shown) are received for purposes of drying. The belt conveyor 12*b* may be powered by electrically operated drive means 12*c*.

The oven enclosure 10*a* includes an exhaust fan 14 and a series of open slots defined between channels 16*a* positioned within a plenum or hood 16, the latter communicating between a source of air from a motor-driven high-velocity air supply fan 20, disposed within the heater enclosure 10*b*, from which heated air is directed through the aforesaid open slots onto the articles being dried. It should be noted that the path of air movement includes recirculation to the air supply fan 20, entering an opening 10*b'* in the heater enclosure 10*b*, and through the plenum 16 and/or to the exhaust fan 14.

The assembled heater enclosure 10*b* includes a portion having a gas-fired heat source 22, where flames from the latter pass within a duct or passageway 25 disposed in the direction of the space within the heater enclosure 10*b* containing the air supply fan 20. Importantly, in this latter connection, the flames from the heat source 22 are confined within a preselected portion of the duct 25, precluding any direct contact with the movement of solvent saturated air between the oven enclosure 10*a* and the heater enclosure 10*b*.

The heating of outside air, introduced through a baffle type intake 29, is accomplished through a duct or passageway 30 surrounding the duct or passageway 25. In other words, the flame heats duct or passageway 25, which, in turn, by radiation, heats the air being drawn by the air supply fan 20 through intake 29, and thereafter into the plenum or hood 16.

The invention importantly precludes any contact by the flame with the highly solvent saturated air resulting through drying action of the articles, where contaminated air is exhausted and treated through conventional means. A regulatory code-safe, as well as a anti-pollution effect, results.

From the preceding, it should be apparent that the invention provides a simple, yet effective, approach in minimizing an important ecological problem. The described components may, of course, be modified, as by proportioning, rearrangement or the like, all within the spirit of the invention. Thus, the above description should be considered illustrative and not as limiting the scope of the following claims:

We claim:

1. A drying oven comprising a housing defined by a heating enclosure and an oven enclosure, a source of heat having a flame, means providing a first elongated passageway having an open end providing communication between said first passageway and said heating enclosure, said heat source being disposed to direct said flame into said first passageway toward said open end such that the heat and combustion product from said flame are directed into said heating enclosure, said first passageway and said heat source confining said flame within said first passageway, means providing a second passageway surrounding said first passageway and having an open end providing communication between said second passageway and said heating enclosure, means providing an air inlet opening into said second passageway, means providing an exhaust opening from said heating enclosure into said oven enclosure, means for circulating air from said inlet opening through said second passageway into said heating enclosure to mix with said combustion product and then through said exhaust opening into said oven enclosure, whereby the air is heated in said second passageway and heated further in said heating enclosure, and said air circulating means being disposed in said heating enclosure.

2. The drying oven of claim 1 including means providing a third passageway between said oven enclosure and said heating enclosure, said air circulating means recirculating air from said oven enclosure back through said heating enclosure to reheat the air, said third passageway being disposed such that the recirculated air does not contact said flame.

3. A drying oven comprising a housing defining a heating enclosure and an oven enclosure having partition means therebetween, a tube extending into said heating enclosure and having opposite outer and inner ends, said inner end being open to provide for communication between said tube and said heating enclosure, a source of heat for directing a flame into the outer end of said tube toward said inner end such that the heat from the flame and the combustion product are directed into said heating enclosure, said tube and said source of heat containing the flame within said tube, means providing a second passageway extending along and surrounding said tube and having an air inlet opening adjacent the outer end of said tube, means providing an air exhaust opening for communication between said heating enclosure and said oven enclosure, said exhaust opening being disposed at a point inwardly from the inner end of said tube, blower means for moving air in through said inlet opening and through said second passageway and along and over said tube into said heating enclosure to be heated and through said exhaust opening into said oven enclosure, said partition means having another opening providing communication between said oven enclosure and said heating enclosure and through which air recirculates from said oven enclosure back through said heating enclosure to be reheated.

* * * * *

UNITED STATES PATENT OFFICE

CERTIFICATE OF CORRECTION

Patent No. 3,999,306 Dated December 28, 1976

Inventor(s) Robert L. Koch, II and William D. Craig

It is certified that error appears in the above-identified patent and that said Letters Patent are hereby corrected as shown below:

Change the Inventors from "Robert L. Koch, II; William D. Graig" to -- Robert L. Koch, II; William D. Craig --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*